US005348390A

United States Patent [19]

Schertenleib

[11] Patent Number: 5,348,390

[45] Date of Patent: Sep. 20, 1994

[54] METHOD AND APPARATUS FOR MIXING PULVEROUS SOLIDS INTO A LIQUID PHASE

[75] Inventor: Peter Schertenleib, Rehau, Fed. Rep. of Germany

[73] Assignee: Erich Netzsch GmbH & Co. Holding KG, Fed. Rep. of Germany

[21] Appl. No.: 78,226

[22] PCT Filed: Oct. 22, 1992

[86] PCT No.: PCT/EP92/02426

§ 371 Date: Jun. 21, 1993

§ 102(e) Date: Jun. 21, 1993

[87] PCT Pub. No.: WO92/11266

PCT Pub. Date: Jul. 9, 1992

[30] Foreign Application Priority Data

Oct. 29, 1991 [DE] Fed. Rep. of Germany ..... 4135648

[51] Int. Cl.[5] ..... B01F 15/02; B01F 15/06; B01F 13/06

[52] U.S. Cl. ..... 366/136; 366/139; 366/144; 366/159; 366/163

[58] Field of Search ..... 366/136, 137, 144, 150, 366/139, 142, 22, 159, 160, 23, 16, 17, 161, 163, 152, 162

[56] References Cited

U.S. PATENT DOCUMENTS

| | | | |
|---|---|---|---|
| 4,518,261 | 3/1983 | Sekimoto et al. | 366/150 |
| 4,863,277 | 9/1989 | Neal | 366/137 |
| 4,955,723 | 9/1990 | Schneider | 366/139 |
| 5,046,856 | 9/1991 | McIntire | 366/137 |

FOREIGN PATENT DOCUMENTS

| | | |
|---|---|---|
| 291209 | 4/1988 | European Pat. Off. . |
| 1457176 | 12/1970 | Fed. Rep. of Germany . |
| 3627875 | 2/1988 | Fed. Rep. of Germany . |
| 1249827 | 8/1969 | United Kingdom . |
| 2154891 | 3/1984 | United Kingdom . |

*Primary Examiner*—Robert W. Jenkins

*Attorney, Agent, or Firm*—Brumbaugh, Graves, Donohue & Raymond

[57] ABSTRACT

An apparatus for mixing pulverous solids into a liquid phase substantially consists of a gas-tight mixing vessel (10), a solids metering means (12), and a pumping means (14). Gas used for pneumatic conveyance and becoming enriched with liquid in the mixing vessel (10) is aspired by the pumping means (14) and recycled to the solids metering means (12) through a return conduit (54). At least one condenser (58, 66) is arranged in the return conduit (54) to eliminate the liquid so that the liquid contained in the gas is largely condensed off and its sticking to the solids to be metered is avoided. The operation of the apparatus and the corresponding method are to the greatest extent possible free of emissions.

21 Claims, 1 Drawing Sheet

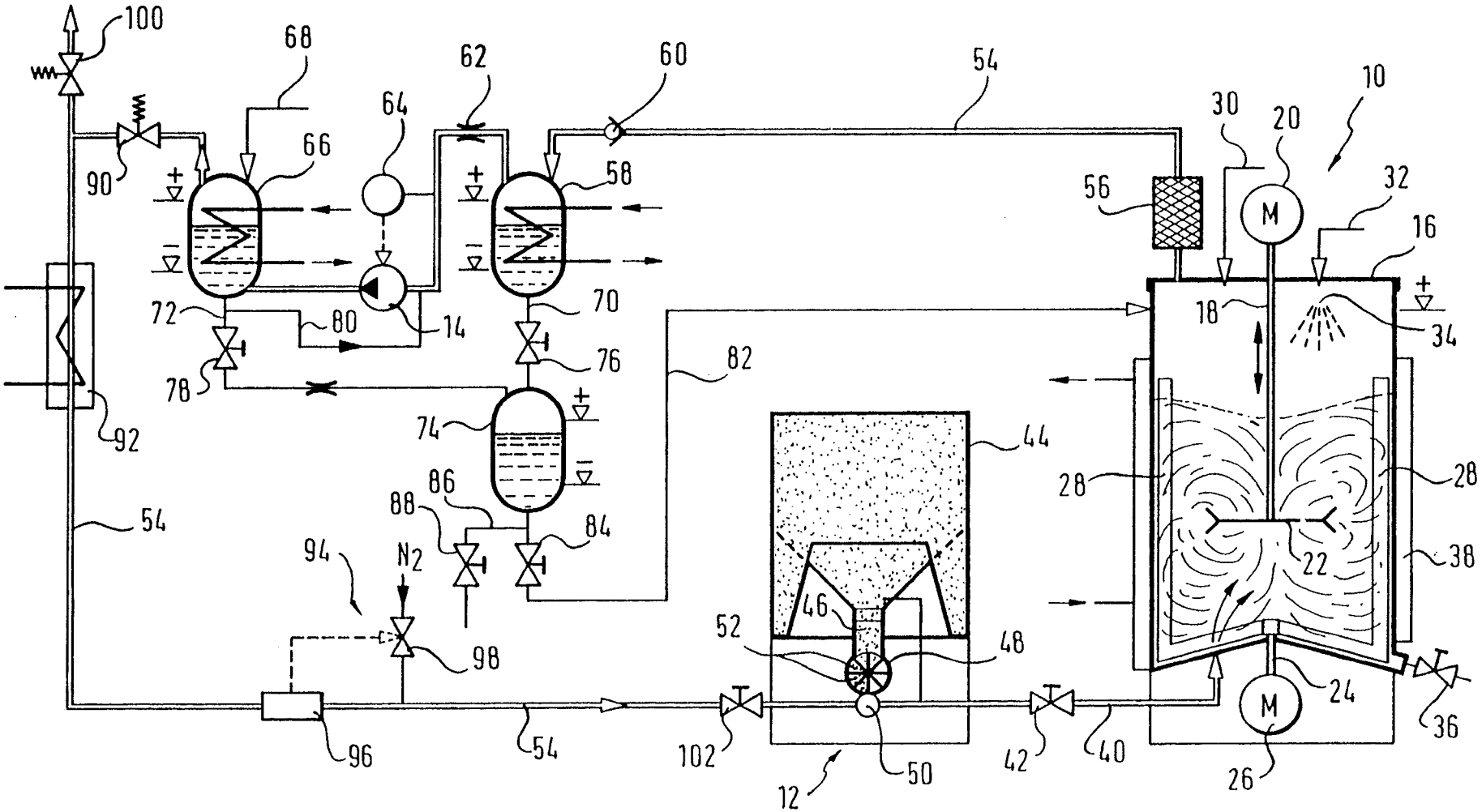
10
12
14
16
18
20
22
24
26
28
30
32
34
36
38
40
42
44
46
48
50
52
54
56
58
60
62
64
66
68
70
72
74
76
78
80
82
84
86
88
90
92
94
96
98
100
102
N2

METHOD AND APPARATUS FOR MIXING PULVEROUS SOLIDS INTO A LIQUID PHASE

The invention relates to a method of mixing pulverous solids into a liquid phase and a corresponding apparatus.

Methods and apparatus of this kind are being used, for instance, in the production of magnetic tapes, printing inks, varnishes, and in the pharmaceutical industry. Often the liquid phase is a solvent.

An apparatus of the generic kind in question is known from EPA 0 291 209 with which pulverous solids are conveyed pneumatically with the aid of gas from a solids metering means into a mixing vessel. In this case the solids are added below the liquid level of the liquid phase contained in the mixing vessel (so-called below-level procedure) as this facilitates mixing with the liquid phase, especially if the particles are very small and light. The solids can be conveyed into the mixing vessel either under excess pressure, or they can be sucked into the mixing vessel by vacuum established inside the same. Whatever the case, a considerable amount of solvent escapes from the mixing vessel when the excess gas is sucked off or the vacuum created. This loss of solvent must be compensated because often the ratio between "solvent" and "solids" is strictly specified. Therefore, production costs are increased. Another problem results from the fact that such an apparatus no longer fulfills the conditions (e.g. TA-Luft—technical instruction concerning air) stipulated by public authorities during the past few years due to the increasing awareness of the environment.

A method of and an apparatus for scrubbing exhaust air which contains solvents are known from German patent 36 27 875. In that case the exhaust air first is pre-dehydrated in a cooler and then flows through an absorber in the form of a molecular screen. The absorber is regenerated by passing heated gas through the molecular screen. As an alternative, regeneration may be accomplished by low pressure. Although good purity of the exhaust air can be obtained in this manner, molecular screens are not suitable for scrubbing the kind of exhaust air produced with mixing apparatus of the generic kind in question. The possible contamination of the exhaust air with very fine pulverous material would cause clogging of the fine pores of a molecular screen within a short time, thus rendering it useless, even if a prefilter were provided.

GB 2 154 891A discloses the process principle of circulating a gas phase which is supplied to a mixer for mixing purposes and leaves the mixer after the mixing operation, then feeding it again to the mixer. Any components which are entrained by the gas phase as it leaves the mixer are filtered out by a separator before the scrubbed gas phase is returned to the mixer.

It is the object of the invention to devise a method and an apparatus for mixing pulverous solids into a liquid phase making it possible to fulfill stricter emission requirements and permitting better cost-efficient production while, at the same time, maintaining the advantages of the apparatus specified.

This object is met, in accordance with the invention, by a method and an apparatus.

The invention is based on the finding that the underlying problem can best be solved by means of a closed gas circuit. However, the gas serving merely as a means of conveyance cannot simply be returned through the solids metering means back into the mixing vessel because the circulating gas stream would become enriched up to the saturation limit with solvents and that would lead to an agglomeration of the solids being conveyed, thereby plugging up the solids metering means and any conduits down the line. In accordance with the invention, therefore, the liquid contained in the circulating gas flow is condensed off at least to such an extent as to avoid the risk of the material sticking together. The condensed liquid can be fed back at once into the mixing vessel.

An advantageous embodiment of the apparatus according to the invention comprises a condenser each upstream and downstream of the pumping means, with higher pressure prevailing in the condenser downstream of the pumping means than in the one upstream of the pumping means. The higher pressure in the condenser which follows the pumping means promotes the further condensing. Preferred are condensers which are cooled in order to obtain the most efficient condensing process.

In an embodiment of the apparatus according to the invention the condenser(s) is/are connected at the condensate end to the mixing vessel so that the condensate can be recycled directly into the mixing vessel. Preferably, however, the condenser(s) is/are connected to a condensate accumulator which in turn is connected at its condensate end to the mixing vessel. Such an arrangement makes it easier to adjust the apparatus to varying liquid loads and it is easier to maintain different pressure levels in the individual condensers.

Where the apparatus is exposed to varying ambient temperatures, especially a return conduit leading from the last condenser to the solids metering means is designed to be heatable in order to prevent residual moisture which remained in the gas stream from condensing off when the dew point is failed to be reached at low ambient temperatures, thus causing undesirable sticking to the solids being conveyed.

Conveniently, a controller is disposed in the return conduit for adjustment of the volume flow and operating pressure so as to facilitate operations and maintain constant process conditions.

The gas which serves as the means of transportation, in principle, may be any gas. In view of the fact, however, that specifically heavy gases permit heavier loading of the gas flow with solids it is preferred to use gases which are rich in nitrogen, such as air and all the way to pure nitrogen as the means of conveyance.

Many liquids, such as most solvents are readily inflammable. To avoid autogenous ignition in the gas circuit, particularly during start-up but also during operation it is preferred to have a safety means which monitors the respective ignition limits and introduces an inert gas into the gas circuit in case of imminent danger, thereby lowering the oxygen concentration to harmless values. It is preferred to introduce nitrogen as the inert gas as it has the effect of increasing the loading capacity.

An embodiment of the invention will be described in greater detail below with reference to a drawing which is a diagrammatic presentation of the apparatus and a process flow diagram at the same time.

The principal component parts of the apparatus are a gas-tight mixing vessel 10, a solids metering means 12, and a pumping means 14. The mixing vessel 10 has a cover 16 through which a fast running agitator shaft 18 extends in gas-tight manner and so as to be driven by a motor 20 disposed outside of the mixing vessel. At its end in the vessel the agitator shaft comprises a fine toothed disc 22. The agitator shaft 18 is vertically adjustable, as indicated by an arrow.

Another shaft 24 extends through the conical bottom of the mixing vessel 10, having its lower end connected to a motor 26 so as to be driven, while its upper end is connected to mixing arms 28 which, at the same time, serve as wiper for the inside wall of the mixing vessel 10.

A conduit 30 for the supply of the liquid phase opens through the cover 16 into the mixing vessel 10. As an alternative, the liquid phase also can get into the mixing vessel 10 from a conduit 32 through cleaning spray nozzles 34. A discharge valve 36 permits emptying of the mixing vessel 10. The mixing vessel 10 can be heated by means of a heater 38.

A supply conduit 40 equipped with a valve 42 links the solids metering means 12 with the mixing vessel 10. The solids metering means 12 essentially consists of a funnel-shaped reservoir 44 which may be of gas-tight structure, a star feeder 48 disposed below the outlet 46 of the reservoir 44, and a turbulence chamber 50 which is arranged in the supply conduit 40 and into which the contents of the individual compartments 52 of the star feeder 48 are emptied.

A return conduit 54 equipped with a filter 56 leads from the cover 16 of the mixing vessel 10 to a first condenser 58 which is cooled by cooling coils or plate-type cooling. A non-return valve 60 is provided in that part of the return conduit 54 which leads from the mixing vessel 10 to the first condenser 58 to prevent return flow into the mixing vessel 10. From the gas phase of the first condenser 58, the return conduit 54 leads through a throttle 62 to the suction end of the pumping means 14. Pressure measurement and control 64 are provided for in the return conduit 54 between the first condenser 58 and the suction end of the pumping means 14.

The return conduit 54 leads on from the pressure end of the pumping means 14 into a second condenser 66 likewise cooled by cooling coils or a plate-type cooler. A filling conduit 68 likewise opens into the second condenser 66. Both condensers 58 and 66 are connected at their respective condensate ends through conduits 70, 72 to a condensate accumulator 74. Both condensers 58, 66 are provided with level control to avoid overfilling so that any excess condensate will flow through the conduits 70, 72 into the condensate accumulator 74. A valve each 76, 78 is arranged in the conduits 70, 72. A bypass conduit 80 passes from conduit 72 to the suction end of the pumping means 14.

The condensate accumulator 74, likewise provided with level control, is connected at its condensate end through a conduit 82 equipped with a valve 84 to the mixing vessel 10. The contents of the condensate accumulator 74 can be drained through a conduit 86 provided with a valve 88.

From the gas phase of the second condenser 66, the return conduit 54 passes through a pressure controller 90 and conduit heater means 92 to a safety means 94.

The safety means 94 substantially consists of a gas detector 96 to determine the oxygen concentration of the gas stream in the return conduit 54 and a control valve 98 which is connected to a control unit (not shown) and through which nitrogen can be introduced into the return conduit 54. Any excess pressure in the apparatus which may result from the introduction of nitrogen can escape through a pressure relief valve 100 provided in the return conduit 54. The pressure relief valve 100 may be connected to a known reaction filter to hold back solvent. The monitoring of the oxygen concentration so as to maintain a sufficiently great safety margin from the ignition limits of the respective gas mixture in the return conduit 54 also works when the apparatus is not operating.

The return conduit 54 passes from the safety means 94 through a valve 102 into the solids metering means 12, thereby closing the gas circuit.

An operating process of the apparatus described above will now be explained in greater detail. Switch-on of the pumping means 14 will cause circulation of the gas (for example air) serving as a means of conveyance in the apparatus which, at first, is pressureless. The gas sucked out of the mixing vessel 10 is stored preliminarily at a higher pressure level in the second condenser 66. The second condenser 66 contains a liquid of compatible composition supplied through filling conduit 68, and the circulating gas coming from the pumping means 14 flows through this liquid for cooling. If necessary, this liquid also may serve as the operating liquid of the pumping means.

In the meantime, the required quantity of liquid (for example a solvent) has been supplied through conduit 30 or 32 to the mixing vessel 10 which is mounted on weighing cells (not shown). The motors 20 and 26 cause rotation of the fine toothed disc 22 and the mixing arm 28 by way of the corresponding shafts.

The solid material for dosing is contained in the reservoir 44 of the solids metering means 12. The formation of bridges in the reservoir 44 is prevented by emptying aids (not shown), such as pneumatic knocking devices or fluidizing floors.

The gas volume flow needed to convey the solids is withdrawn from the condenser 66 by means of the pressure controller 90 and flows through the return conduit 54 to the solids metering means 12. In the turbulence chamber 50 of the solids metering means 12 the gas flow gets in touch with the solids metered through the outlet 46 and the star feeder 48 into the turbulence chamber 50, conveying the same pneumatically through the supply conduit 40 into the mixing vessel 10. The reservoir 44 of the solids metering means 12 is of advantageously gas-tight design, although it may also be operated open to atmosphere.

As the figure demonstrates, the supply conduit 40 opens in the bottom of the mixing vessel 10, i.e. the solids feeding is in the below-level manner. Yet this type of supply is not absolutely required; the solids may just as well be fed into the mixing vessel 10 above the liquid level, depending on the type of solids.

Enriched with the liquid in the mixing vessel 10 due to evaporation, the gas stream is sucked off by the pumping means 14, passing through the filter unit 56 into the return conduit 54 and reaching the first, cooled condenser 58 in which precondensation of the gas mixture takes place. That part of the liquid which is condensed off the gas stream is collected in the lower part of the condenser 58. The gas flow leaves the condenser 58 through the throttle 62 for control of the volume flow and, having passed the pumping means 14, it reaches the second condenser 66 which likewise is cooled and in which post-condensation takes place which is accelerated and intensified due to the higher pressure level in the condenser 66. The gas which now has been largely freed of liquid leaves the second condenser 66 and flows through a section of the return conduit 54 which has been warmed up by the conduit heater means 92 back to the solids metering means 12 where it is loaded once more with solids. The loss of liquid in the mixing vessel 10 resulting from the aspiration of evaporated liquid is compensated by recycling of the condensate obtained in condensers 58 and 66 through conduits 70 and 72 into the condensate accumulator 74 and on through conduit 82 into the mixing vessel 10. When the desired amount of solids has been metered into the mixing vessel 10 the pumping means 14 is switched off and the positive pressure prevailing in the condenser 66 is used to urge back into the mixing vessel 10 all the condensate collected in the condensers 58 and 66 and in the condensate accumulator 74. In this manner it is warranted, at the same time, that no greater quantities of previously used liquid are left behind in the apparatus when a changeover is made to a different liquid needed for a different batch. Simultaneously, a pressure balance with atmosphere is achieved in case low pressure should have prevailed in the mixing vessel 10 and, therefore, the mixing vessel 10 can be opened readily afterwards.

The safety means 94 in cooperation with the gas detector 96 constantly monitors the oxygen concentration in the gas both during operation and standstill of the apparatus and, if a concentration of oxygen which is dangerous in respect of an autogenous ignition develops, it introduces an inert gas, such as nitrogen until the oxygen concentration is within a harmless range.

A suitable liquid is sprayed into the mixing vessel 10 through the cleaning nozzles 34 in order to clean the mixing vessel. Upon cleaning, the mixing vessel 10 is made entirely free of washing liquid by heating it by means of its heater 38 whereby any washing liquid which remained in the mixing vessel 10 after the greater part of the washing liquid was drained will evaporate. The evaporated share of the washing liquid need not remain in the apparatus nor need it be discharged into atmosphere. Instead, it can be largely recovered in the same way as described above by means of the two condensers 58 and 66. The washing liquid thus recovered is passed out of the apparatus through conduit 86 and valve 88.

What is claimed is:

1. A method of mixing pulverous solids into a liquid phase, wherein the solid material is metered pneumatically into a mixing vessel (10) containing the liquid phase, and a gas phase located above the liquid phase is aspired by a pumping means (14), characterized in that liquid contained in the gas phase is condensed off, at least partly, at a location remote from the pumping means, and the gas phase is recycled into the mixing vessel (10) in a closed gas circuit through a solid metering means.

2. The method as claimed in claim 1, characterized in that liquid contained in the gas phase is condensed off upstream and downstream of the pumping means (14), the pressure level for condensing being higher downstream of the pumping means than upstream thereof.

3. The method as in claim 1 wherein the location at which the liquid contained in the gas phase is condensed off is upstream of the pumping means.

4. The method as in claim 1 wherein the location at which the liquid contained in the gas phase is condensed off is downstream of the pumping means.

5. The method as claimed in claim 1, claim 2, claim 3, or claim 4, characterized in that the condensing is effected by cooling.

6. The method as claimed in claim 5, characterized in that the condensate is recycled into the mixing vessel (10).

7. The method as claimed in claim 6, characterized in that the volume flow and the operating pressure are controlled.

8. The method as claimed in claim 7, characterized in that the gas phase to be recycled into the mixing vessel (10) is heated.

9. The method as claimed in claim 8, characterized in that the ignition limits in the closed gas circuit are monitored and inert gas is introduced into the gas circuit in case of danger.

10. The method as claimed in claim 9, characterized in that specifically heavy gas is introduced into the closed gas circuit.

11. An apparatus for mixing pulverous solids into a liquid phase, comprising a gas-tight mixing vessel (10) in which there is at least one mixing member (22, 28), a solids metering means (12) connected to the mixing vessel (10), and a pumping means (14) whose suction end communicates with a gas phase contained in the mixing vessel above the liquid phase, characterized in that the pressure end of the pumping means (14) is connected to the solids metering means (12), thus forming a closed gas circuit, and at least one condenser (58, 66) is arranged in the gas circuit at a location remote from the pumping means (14) to eliminate the liquid.

12. The apparatus as claimed in claim 11, characterized in that a condenser each (58, 66) is disposed upstream and downstream of the pumping means (14) and the pressure in the condenser (66) downstream of the pumping means (14) is higher than in the condenser (58) upstream of the pumping means.

13. The apparatus as claimed in claim 11 wherein at least one condenser is disposed at a location upstream of the pumping means.

14. The apparatus as claimed in claim 11 wherein at least one condenser is disposed at a location downstream of the pumping means.

15. The apparatus as claimed in claim 11, claim 12, claim 13, or claim 14, wherein each condenser is cooled.

16. The apparatus as claimed in claim 15, wherein each condenser is connected at the condensate end to the mixing vessel (10).

17. The apparatus as claimed in claim 16, wherein each condenser is connected to a condensate accumulator (74) whose condensate end is connected to the mixing vessel.

18. The apparatus as claimed in claim 17, characterized in that the pressure end of the pumping means (14) is connected to the solids metering means (12) by a heatable return conduit (54).

19. The apparatus as claimed in claim 18, characterized in that a controller (64, 90) is arranged in the return conduit (54) for adjustment of the volume flow and operating pressure.

20. The apparatus as claimed in claim 19, characterized in that a safety means (94) is provided to monitor the ignition limit and introduce inert gas into the gas circuit in case of danger.

21. The apparatus as claimed in claim 20, characterized in that the gas phase essentially consists of specifically heavy gas.

* * * * *